United States Patent [19]

Gebelius

[11] Patent Number: 4,747,725

[45] Date of Patent: May 31, 1988

[54] DEVICE FOR POLE-SHAPED ELEMENTS

[76] Inventor: Sven R. V. Gebelius, Box 15008, Bromma, Sweden, S-161 15

[21] Appl. No.: 5,340

[22] Filed: Jan. 15, 1987

Related U.S. Application Data

[63] Continuation of Ser. No. 764,255, filed as PCT SE84/00424 on Dec. 12, 1984, published as W085/02636, Jun. 20, 1985 abandoned.

[30] Foreign Application Priority Data

Dec. 13, 1983 [SE] Sweden ..... 8306871

[51] Int. Cl.[4] ..... E01F 9/01

[52] U.S. Cl. ..... 404/10; 40/608

[58] Field of Search ..... 404/10, 11; 40/608, 40/612; 52/99, 232; 267/158, 160, 165; 188/376, 371

[56] References Cited

U.S. PATENT DOCUMENTS

| | | | |
|---|---|---|---|
| 1,273,607 | 7/1918 | Hawks | 40/608 |
| 1,295,316 | 2/1919 | Hines | 267/160 |
| 2,022,745 | 12/1935 | Slavin | 40/608 |
| 2,474,124 | 6/1949 | Schultz | 188/371 |
| 3,366,353 | 1/1968 | Jackson | 188/371 |
| 3,838,661 | 10/1974 | Medley, Jr. | 40/608 X |
| 4,491,438 | 1/1985 | Berutti | 404/10 |
| 4,565,466 | 1/1986 | Daggs et al. | 404/10 |

FOREIGN PATENT DOCUMENTS

| | | | |
|---|---|---|---|
| 142817 | 6/1978 | Denmark . | |
| 0006984 | 1/1980 | European Pat. Off. . | |
| 0042810 | 12/1981 | European Pat. Off. . | |
| 2306421 | 8/1974 | Fed. Rep. of Germany . | |
| 2445842 | 4/1976 | Fed. Rep. of Germany . | |
| WO79/00391 | 7/1979 | PCT Int'l Appl. . | |
| 524731 | 8/1972 | Switzerland . | |
| 873559 | 1/1961 | United Kingdom | 404/10 |
| 1015298 | 12/1965 | United Kingdom | 188/371 |
| 1060974 | 3/1967 | United Kingdom | 188/371 |

*Primary Examiner*—James A. Leppink
*Assistant Examiner*—Hoang C. Dang
*Attorney, Agent, or Firm*—Holman & Stern

[57] ABSTRACT

Device for a pole-shaped element (1), which is attached against a base (2) adjacent to a ground plane (3) in such a way, that it is released when made subject to a collision within a region adjacent to the base (2). One or a number of straps (4) are arranged extending between a first point of attachment adjacent to the upper portion of the pole-shaped element (1) and a second point of attachment in relation to the ground plane (3), adjacent to the base (2). When the pole-shaped element (1) is made subject to influence from a collision with a vehicle (6), the pole-shaped element (1) is released from the base (2), and due to the strap/the straps (4), which hereby receives an extension exceeding the distance between the first and the second point of attachment, the distance as the pole-shaped element (1) can be thrown over the vehicle (6) is restricted, and the strap/the straps (4) also act as braking means, which during a certain distance reduce the speed of the vehicle (6), and retain same at a point adjacent to the location of collision.

10 Claims, 2 Drawing Sheets

Fig. 3
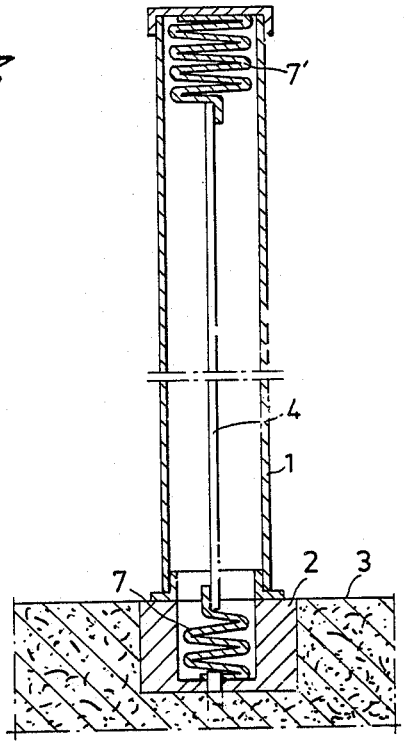
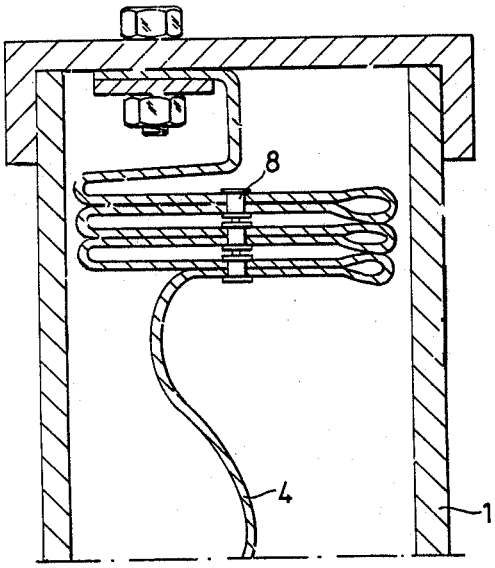
Fig. 4

DEVICE FOR POLE-SHAPED ELEMENTS

This is a continuation of application Ser. No. 764,255, filed as PCT SE84/00424 on Dec. 12, 1984, published as WO85/02636 on Jun. 20, 1985, now abandoned.

CROSS REFERENCE TO RELATED APPLICATION(S)

This U.S. application stems from PCT International Application No. PCT/SE84/0042 filed Dec. 12, 1984.

The present invention relates to a device for pole-shaped elements, intended to reduce the risk for damage caused by collision with a vehicle. Various types of pole-shaped elements exist adjacent to a road surface, utilized to support illumination, signs, traffic signals, electrical and telecommunication cables, and also utilized for other purposes. When such pole-shaped elements are hit by a vehicle, considerable damage can occur, both material damage as well as injuries to persons. This fact is well known, and various solutions, intended to reduce the extent of the damage, have also been proposed. An example of such a previously known solution is to arrange the pole-shaped members with a fractural impression adjacent to the ground surface, in order to facilitate disengagement from the base foundation, and it is further desirable that the removed pole-shaped element, if possible, should perform a movement over a colliding vehicle, and fall down behind same. Furthermore, attempts have been made to arrange previously known types of pole-shaped elements as lattice structures having sections with a relatively small cross-section, in order to provide a pole which relatively softly can be plastically deformed in a collision, and thereby reduce the movement of a vehicle during a longer distance, i.e. in order to accomplish a slower braking operation. However, the increase in braking distance thus accomplished will be marginal, and resulting damage will still be excessive. In practical use, the high cost for poles having lattice structure has often resulted in the use of various types of protective railing arranged surrounding the base foundation, whereby the intended protection no longer exists for a colliding vehicle.

The device according to the present invention can be used for pole-shaped elements having a non-solid cross-section, and is particularly suitable for use in connection with pole-shaped elements having a tubular cross-section, even though other cross-sectional configurations can be utilized. The object of the present invention is to disclose a possibility to slow down the speed of a colliding vehicle over a relatively long distance, and further to remove previously existing risks for injuries against a third party caused by a pole thrown over a colliding vehicle, and the uncontrolled fall at a distance from previous location. Damage on the vehicle and the pole, as well as light fittings or similar supported by the pole, will further be restricted to a minimum. Furthermore, the pole-shaped members can be arranged considerably simpler and cheaper than previously known elements having plastically deformable properties, i.e. previously known pole-shaped elements which during a collision by means of plastical deformation facilitate that the speed of a colliding vehicle is slowed down during a certain distance of travel.

The main and characteristic features of the device according to the present invention are disclosed in the following main claim, and further characteristic features are disclosed in related sub-claims.

Examples of embodiments of devices according to the present invention are more fully described below with reference to the accompanying drawings, in which:

FIG. 3 shows a side elevation of a pole-shaped element, including an example of a second embodiment of a device according to the present invention.

FIG. 4 shows a side elevation of an end portion of a pole-shaped element, with a third example of an embodiment of a device according to the present invention.

Figure 1:
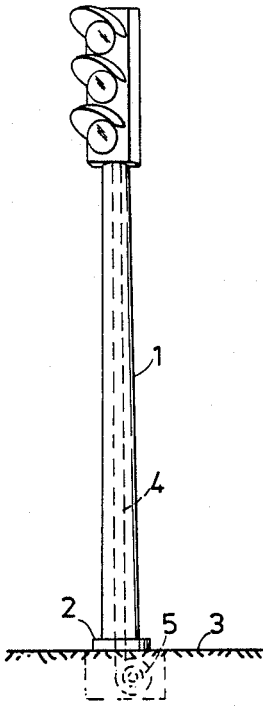
FIG. 1 shows a side elevation of a pole-shaped element, arranged supporting a traffic light, and with the pole-shaped element including a first example of an embodiment of a device according to the present invention.

With reference to the embodiment shown in FIG. 1, same is shown in connection with a pole-shaped supporting element 1 having a tubular cross-section, attached to a base 2 adjacent to a ground plane 3. The pole-shaped supporting element 1 surrounds a strap 4, preferably being a woven flexible strap of a synthetic fibre material or similar, which in relation to one end portion is attached at the upper portion of the pole-shaped supporting element 1, and having the opposed end portion arranged wound on a roll-shaped member 5, located below the ground plane 3 adjacent to the base 2. Said roll-shaped member 5 further includes a brake device which facilitates unwinding of the wound portion of the strap 4 from the roll-shaped member 5 with a predetermined braking force. Finally, the pole-shaped supporting element 1 is attached to the base 2 in such a way, that it can be released from the base 2 when made subject to a collision with an approaching vehicle.

Figure 2:
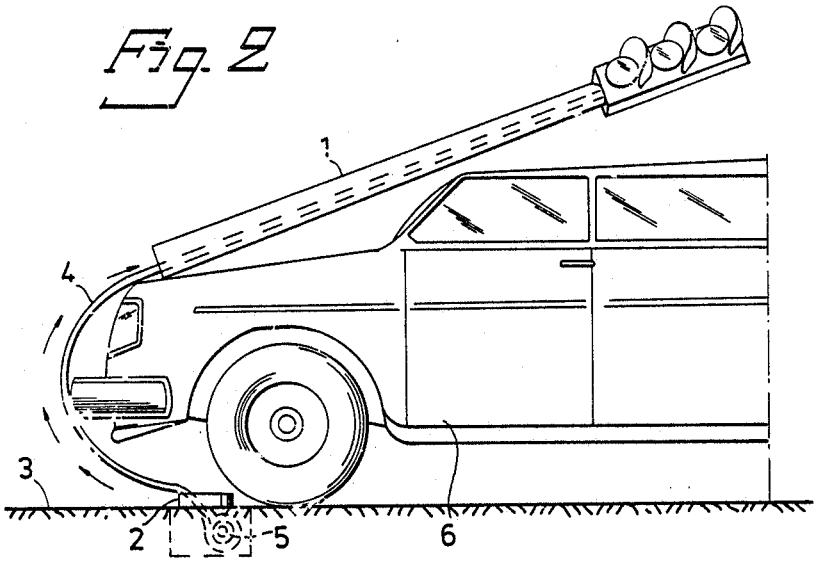
FIG. 2 shows a side elevation of a pole-shaped element shown in FIG. 1 when same is being hit by a colliding vehicle.

The method according to which the device described with reference to FIG. 1 acts when the pole-shaped supporting element 1 is subjected to a collision with a vehicle is shown in FIG. 2. When a vehicle 6 hits the pole-shaped supporting element 1 in the region adjacent to the point of attachment against the base 2, the pole-shaped supporting element 1 is released from the base 2, and the strap 4 is unwound from the roll-shaped member 5, as indicated by arrows. Due to the previously discussed brake device, said unwinding is performed while maintaining a braking force, and said force can either be continuous during unwinding, or advantageously be arranged to be continuously increased, i.e. with a continuosly increasing braking action during the unwinding operation. Due to the force applied against the lower portion from the colliding vehicle 6, the pole-shaped supporting member 1, when released from the base 2, will fall in direction towards the direction of travel for the vehicle with its upper portion, and since the outer end portion of the strap 4 wound on the roll-shaped member 5 is ridgidly attached to said member 5, unwinding can only be performed during a certain predetermined distance, e.g. corresponding to the distance shown in FIG. 2, but also a longer unwinding distance can be used. The strap 4 thus acts as a catching member for the colliding vehicle 6, but also as a restricting member for the pole-shaped supporting element 1, which thus is held within an area adjacent to the base 2 and the location for the collision, whereby the risk for injuries on other vehicles, or persons located nearby, substantially completely is eliminated.

An example of an alternative embodiment is shown in FIG. 3, in which previously discussed roll-shaped member 5 with associated brake device has been replaced by a metal strip 7 bent in zig-zag-shape, having one end portion arranged ridgidly attached below the ground plane 3 at the base 2, and with the other end portion arranged attached to the flexible strap 4, which is arranged surrounded by the pole-shaped supporting element 1. A second and correspondingly arranged metal strip 7' is arranged at the upper portion of the pole-shaped element 1, having a first end portion attached against the pole-shaped supporting element 1, and with the other end portion attached to the flexible strap 4. The zig-zag-shaped metal strips 7, 7' are chosen with regard to material thickness and cross-sectional configuration in such a way, that they act as a suitable braking element when same during a collision are streched and reshaped into a substantially longitudinally extending configuration. Advantageously, the thickness and/or width of the metal strips 7, 7' can be varied between said two points of attachment, in order to accomplish a step by step or continuosly varied force necessary for extension of same from the original zig-zag-shape.

It should also be mentioned, that the flexible strap 4 obviously can be directly attached against the base 2, or the upper portion of the pole-shaped supporting element 1, and that thus only one of the metal strips 7, 7' shown is required. Furthermore, a metal strip 7' arranged adjacent to the upper portion of a pole-shaped element 1 results in the possibility to accomplish considerably longer lengths of zig-zag extending metal strips 7' than what normally is possible adjacent to the base 2, and attachment and location of such a metal strip 7' in a position surrounded by the pole-shaped supporting element 1 thus offers a possibility to use zig-zag-shaped metal strips 7' having a longitudinal extension which is only restricted by the length of the pole-shaped supporting element 1, i.e. possibility for long distances of travel for a colliding vehicle 6, and thereby a slower braking of same. Furthermore, it is also obviously possible to arrange one or a number of zig-zag-shaped metal strips 7, 7' along the strap 4 of a type as shown adjacent to the upper and lower portions of the pole-shaped supporting element 1 in FIG. 3.

Finally, FIG. 4 intends to disclose a further example of an embodiment, in which the flexible strap 4 only is shown adjacent to one end portion of a pole-shaped supporting element 1. According to this embodiment, the strap 4 extends in adjacently located loops, having a centrally located joining member 8 for the loops of the strap. Said joining member 8 would in its simplest form comprise stitches joining the loops, but could also comprise a member extending through the strap 4, which is joined to the strap 4 at each point of penetration, or by means of one or two straps, which are joined to the edge portions of the loops in the strap, e.g. by means of stitches. Instead of using stitches for previously discussed attachment, also other means of attachment can be used, as well as a glueing method. When using the method of glueing, adjacently located loops of the strap can be internally directly attached with adjacent surfaces against each other, and the established joint is always arranged in such a way, that it may be released at a predetermined applied force, in order to accomplish a substantially completely longitudinally extending flexible strap 4.

Above described examples of embodiments may obviously also be combined as desired with each other, in one and the same device, and further modifications can obviously also be made, e.g. by arranging more than one strap 4 extending surrounded by a pole-shaped supporting element 1. Furthermore, the method in which such a strap 4 is arranged longitudinally extendable when influenced by a force can also be accomplished in other ways than shown and described, and in its simplest form, the present invention can be regarded to include one or several straps 4, extending in longitudinal direction of a pole-shaped supporting element 1, arranged attached in connection to an upper point of such an element 1, and also adjacent to a ground plane 3, nearby the base 2 of such an element 1.

As previously mentioned, utilized straps 4 are advantageously arranged as woven straps of a synthetic fibre material, since such straps 4 result in desired properties, but also other materials may obviously be used, and also metallic materials. The term strap is not intended to disclose only rectangular cross-sectional configuration, even though such a configuration often is advantageous, since also other cross-sectional configurations can be used, while maintaining the important and characteristic features of the invention.

I claim:

1. A vehicle-arresting pole structure for arresting a vehicle of predetermined height in response to a collision of the vehicle with the structure comprising a base assembly, an upright mounted on the base assembly for separation therefrom in response to a collision from the vehicle, the upright being of sufficient height related to the height of the vehicle for falling toward the vehicle responsive to the collision, and at least one elongate, flexible, strap element having one end fixedly attached within the upright and another end fixedly attached within the base assembly, the strap element being compacted lengthwise on itself within the structure for non-retractable lengthwise extension thereof responsive to the collision accompanied by increasing separation of the upright from the base assembly, the strap member having a fully extended length sufficient to provide a length of strap between the upright and the base member forming a vehicle engaging and arresting loop.

2. The structure as defined in claim 1 wherein the strap element is compacted lengthwise by means of a rolled portion of the strap element at least at one end thereof.

3. The structure as defined in claim 2 wherein the rolled portion of the strap element is in the base assembly.

4. The structure as defined in claim 1 wherein the strap element is compacted lengthwise by means of a folded portion of the strap element at least at one end thereof.

5. The structure as defined in claim 4 wherein the folded portion of the strap element has multiple folds and breakaway means releasably securing the folds together for breaking away under forces created by the collision.

6. The structure as defined in claim 5 wherein the breakaway means comprises mechanical fastening means.

7. The structure as defined in claim 5 wherein the breakaway means comprises adhesive means.

8. The structure as defined in claim 5 wherein the folded portion of the strap element is located in the upright and the strap element includes a further folded portion with multiple folds located in the base assembly.

9. The structure as defined in claim 8 including attachment means between the respective folded portions of the strap element and a central section thereof.

10. The invention as defined in claim 9 wherein the folded portions of the strap element are metal strips and the central section is a woven fabric.

* * * * *